US011344110B1

(12) United States Patent
Kron

(10) Patent No.: US 11,344,110 B1
(45) Date of Patent: May 31, 2022

(54) HAIR CLEANING BRUSH

(71) Applicant: Charles J. Kron, Fillmore, NY (US)

(72) Inventor: Charles J. Kron, Fillmore, NY (US)

( * ) Notice: Subject to any disclaimer, the term of this patent is extended or adjusted under 35 U.S.C. 154(b) by 0 days.

(21) Appl. No.: 17/531,391

(22) Filed: Nov. 19, 2021

(51) Int. Cl.

| | |
|---|---|
| ***A46B 9/02*** | (2006.01) |
| ***A46B 7/04*** | (2006.01) |
| ***A45D 19/00*** | (2006.01) |
| ***A46B 15/00*** | (2006.01) |

(52) U.S. Cl.
CPC ..... *A46B 9/023* (2013.01); *A45D 19/0041* (2021.01); *A46B 7/04* (2013.01); *A46B 15/0055* (2013.01); *A46B 2200/104* (2013.01)

(58) Field of Classification Search
CPC ..... A46B 9/023; A46B 7/04; A46B 15/0055; A45D 19/0041; A47L 13/12
See application file for complete search history.

(56) References Cited

U.S. PATENT DOCUMENTS

| | | | | |
|---|---|---|---|---|
| 4,023,230 | A | 5/1977 | Friedman et al. | |
| 7,225,815 | B2 * | 6/2007 | Kung | A46B 17/06 132/119 |
| 7,832,413 | B2 | 11/2010 | Walters et al. | |
| 9,386,758 | B2 * | 7/2016 | Dionne | A01K 13/002 |
| 2008/0098550 | A1 | 5/2008 | Mckay | |
| 2014/0311524 | A1 * | 10/2014 | Call | A46B 7/04 15/104.94 |

* cited by examiner

*Primary Examiner* — Shay Karls
(74) *Attorney, Agent, or Firm* — Vincent G. LoTempio

(57) ABSTRACT

The present invention provides a hair cleaning brush enabled to clean human hair and/or animal fur. The hair cleaning brush comprises a brush body and a handle. The brush body having a top side and a bottom wall extending from a periphery of the top side. A plurality of bristles extending from a periphery of the bottom wall of the brush body. A hole is present in the middle of the brush body. A threaded adjusting rod passes through the hole of the brush body to engage with a pusher plate to hold the pusher plate and one or more replaceable sponge pads inside the brush body. The threaded adjusting rod is configured to displace the pusher plate and one or more replaceable sponge pads from a first position to a second position inside the brush body, in response to rotation of a rotary knob by a user.

10 Claims, 6 Drawing Sheets

HAIR CLEANING BRUSH

FIELD OF THE INVENTION

The present invention is related to a hair cleaning brush having a plurality of bristles and a sponge pad to clean human hair and/or animal fur. The hair cleaning brush is enabled to clean hair and/or fur when a cleaning fluid present on the sponge pad is exposed to the hair and/or fur.

BACKGROUND OF THE INVENTION

Hairbrushes are one of the most common tools found in each household (dressing rooms, dressing tables). Both men and women even carry hair brushes in bags, purses, and pockets. From ordinary combs to sophisticated hair brushes, the market is full of a variety of hairbrushes. These sophisticated hair brushes can be used for hairstyling, have a self-cleaning mechanism, can be used for drying hair or even for hair cleaning. Not only for humans but these hair brushes are available for pet animals as well.

Presently, there are several prior arts available that provide alternative solutions such as U.S. Pat. No. 4,023,230A. The prior art discloses a self-cleaning hairbrush which comprises a handle, a bristle-holding head, and a combing plate. The handle enables a user to hold the self-cleaning hairbrush. The bristle-holding head has a plurality of spaced-apart bristles projecting laterally therefrom. It further comprises a rectangular tube placed at the central position of the bristle-holding head. The combing plate can be placed in two positions. When it is in the first position, the bristles from the bristles-holding head project through the apertures of the combing plate thus making the hairbrush usable for the user. Further, there is a movable plunger that helps to move the combing plate to the second position where the combing plate achieves a position at the free end of the bristles. The movable plunger comprises a latching pin for automatically locking the plunger in an intermediate position between first and second positions. The movable plunger is mounted on a rectangular tube.

In yet another prior art such as US20080098550A1. It discloses a self-cleaning brush with a flexible matrix which comprises a handle and a brush head attached to the handle. A plurality of bristles is present at the base of the brush head. Further, the brush head also comprises a matrix that is made of sponge, form, or other compressible material. When the brush is used on human hair or animal fur, it makes the matrix compress thus exposing the bristles to the human hair or animal fur. When removed from the hair or fur, the matrix decompresses to its original position while also removing any hair, fur, or other entangled material in the self-cleaning brush. A vibrating device incorporated in the hairbrush for the provision of massage of skin and/or scalp has been kept in option.

The above-mentioned prior arts have made certain developments in hairbrushes. In the present invention, the design and ease of use make it unique. It can be used in hospitals, nursing homes for patients for whom taking a head bath is difficult. Further, it can be used even for pet animals that can't be given baths more often.

SUMMARY OF THE INVENTION

Embodiments of the present invention provide a hair cleaning brush having sponge pads for a purpose of hair and/or fur cleaning.

The hair cleaning brush of the present invention comprises a brush body and a handle. The brush body is having a top side and a bottom wall extending from a periphery of the top side. A plurality of bristles are extending from a periphery of the bottom wall of the brush body. A hole is present in the middle of the brush body. A threaded adjusting rod is sized, shaped and designed to pass through the hole of the brush body to engage with one or more threads of a pusher plate to hold the pusher plate and one or more sponge pads inside the brush body. The one or more sponge pads are placed on the top of the pusher plate. A rotary knob is affixed at a top side of the threaded adjusting rod. The threaded adjusting rod is configured to displace the pusher plate and one or more sponge pads from a first position to a second position inside the brush body, in response to rotation of the rotary knob in at least one direction by a user.

In one exemplary embodiment, the one or more sponge pads are replaceable. The one or more sponge pads are enabled to absorb a cleaning fluid that is distributed to a user's hair through the plurality of bristles and the one or more sponge pads while combing. The cleaning fluid is selected from a group consisting of coconut oil, jojoba oil, olive oil, tea tree oil, or any other cleaning fluid.

In one exemplary embodiment, the hair cleaning brush comprises a cap enabled to cover the plurality of bristles and one or more sponge pads of the brush body. The brush body and the handle are made of nylon material. The pusher plate having one or more threads in the middle of the pusher plate. The one or more sponge pads are having a hole in the middle of the one or more sponge pads.

BRIEF DESCRIPTION OF THE DRAWINGS

Embodiments of the present invention described herein are exemplary, and not restrictive. Embodiments will now be described, by way of examples, with reference to the accompanying drawings. In these drawings, each identical or nearly identical component that is illustrated in various figures is represented by a reference number. For purposes of clarity, not every component is labeled in every drawing. The drawings are not necessarily drawn to scale, with emphasis instead being placed on illustrating various aspects of the techniques and devices described herein.

The foregoing and other objects, aspects, and advantages are better understood from the following detailed description of a preferred embodiment of the invention with reference to the drawings, in which.

DETAILED DESCRIPTION OF THE INVENTION

With reference to the figures provided, embodiments of the present invention are now described in detail. In the following description, for the purpose of explanation, numerous specific details are set forth in order to provide a thorough understanding of the invention. It will be apparent, however, to one skilled in the art that the invention can be practised without these specific details. In other instances, structures, devices, activities, and methods are shown using schematics, use cases, and/or flow diagrams in order to avoid obscuring the invention. Although the following description contains many specifics for the purpose of illustration, anyone skilled in the art will appreciate that many variations and/or alterations to suggested details are within the scope of the present invention. Similarly, although many of the features of the present invention are described in terms of each other, or in conjunction with each other, one skilled in the art will appreciate that many of these features can be provided independently of other features. Accordingly, this description of the invention is set forth without any loss of generality to, and without imposing limitations upon, the invention.

The present invention provides a hair cleaning brush which is a hairbrush made for the purpose of hair and/or fur cleaning. It solves the purpose of cleaning human hair or animal fur as well. The hair cleaning brush is made of nylon or any other material.

Figure 1:
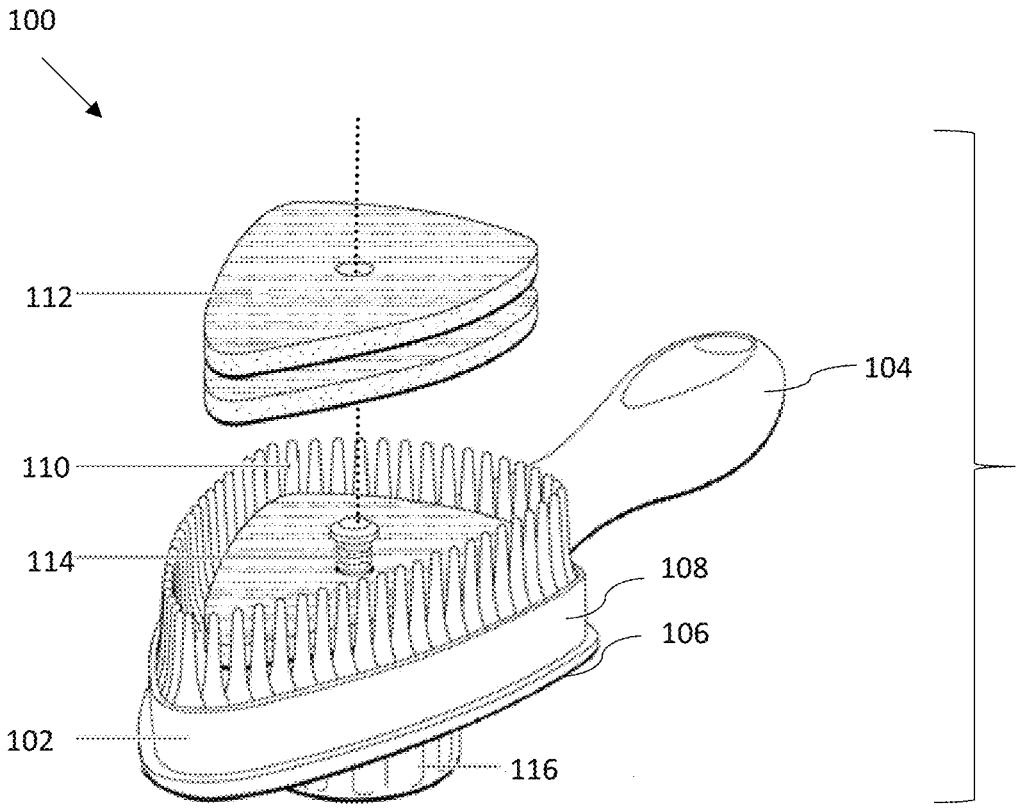
FIG. 1 illustrates a perspective view of a hair cleaning brush, in accordance with an exemplary embodiment of the present invention.

FIG. 1 is a perspective view of a hair cleaning brush (100), in accordance with an exemplary embodiment of the present invention. The hair cleaning brush (100) comprises a brush body (102) and a handle (104). The handle (104) is used to hold the hair cleaning brush (100) while it is being used by a user. The brush body (102) is having a top side (106) and a bottom wall (108), wherein the bottom wall (108) is extending from a periphery of the top side (106). A plurality of bristles (110) are extending from a periphery of the bottom wall (108) of the brush body (102) forming a space in between the brush body (102) to place one or more sponge pads (112). The brush body (102) is preferably a pear-shaped body. The brush body (102) is enabled to receive one or more sponge pads (112). Further, the brush body (102) comprises of a threaded adjusting rod sized (114) having a rotary knob (116) affixed at a top side of the threaded adjusting rod (114).

Figure 2A:
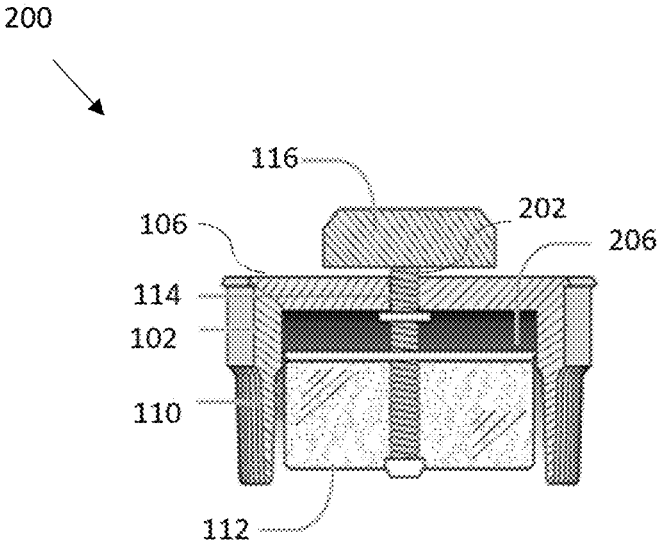
FIG. 2A illustrates a cross-sectional front view of the hair cleaning brush, in accordance with an exemplary embodiment of the present invention taken generally at plane 2A-2A of FIG. 6.
Figure 6:
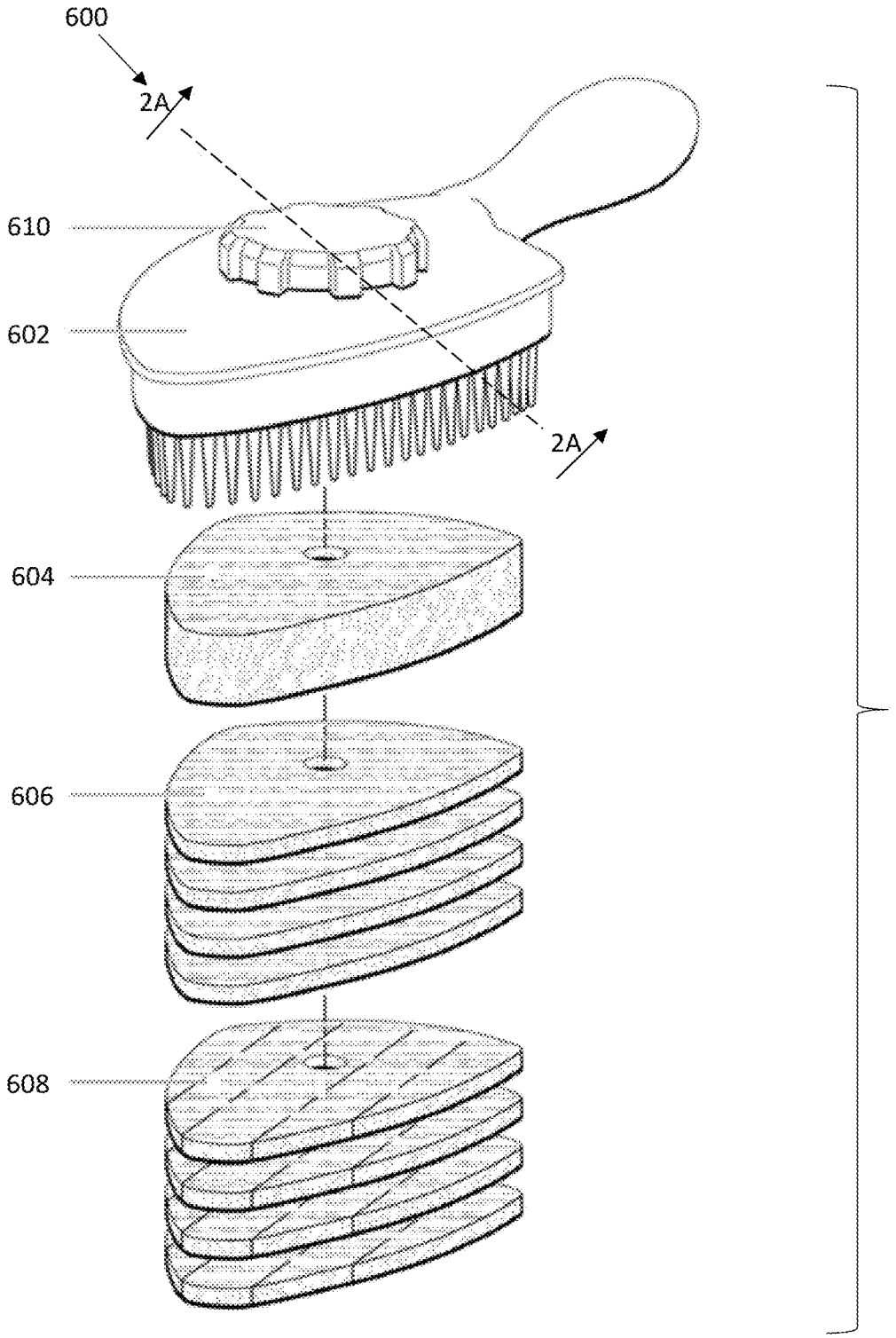
FIG. 6 is an exploded view of the hair cleaning brush and one or more sponge pads, in accordance with an exemplary embodiment of the present invention.

FIG. 2A illustrates a cross-sectional front view (200) of the hair cleaning brush, in accordance with an exemplary embodiment of the present invention taken generally at plane 2A-2A of FIG. 6. The brush body (102) comprises a hole (202) in the middle of the top side (106) of the brush body (102). A threaded adjusting rod (114) is sized, shaped and designed to pass through the hole (202) of the brush body (102) to engage with one or more threads of a pusher plate (206) to hold the pusher plate (206) and one or more sponge pads (112) inside the brush body (102). The one or more sponge pads (112) are placed on the top of the pusher plate (206). The one or more sponge pads (112) are having hole in the middle of the one or more sponge pads (112) enabling the threaded adjusting rod (114) to pass therethrough to hold the one or more sponge pads (112) on the pusher plate (206). The pusher plate (206) and the one or more sponge pads (112) are having the same length.

Further, a rotary knob (116) is affixed at a top side of the threaded adjusting rod (114). The rotary knob (116) is configured to adjust the position of the one or more sponge pads (112) in the brush body (102). The threaded adjusting rod (114) is configured to displace the pusher plate (206) and one or more sponge pads (112) from a first position to a second position inside the brush body (102), in response to rotation of the rotary knob (116) in at least one direction by a user. The at least one direction is a clockwise direction or an anticlockwise direction. The sponge pads are adjusted by moving the pusher plate (206) to a first position, which is proximate brush body 102 and the lowest position, this first position allows a user (i.e. a pet or a human) with thick hair or thick fur to maintain contact with the sponge pad. The second position of the pusher plate (206) is extended distal from the brush body and thus positions the sponge pad at an end of the plurality of bristles (110) which is not attached to brush body and thus position the sponge pad for a user with very thin hair. The rotary knob allows for a plurality of positions between the first and second position based upon the thickness of the users hair.

Figure 2B:
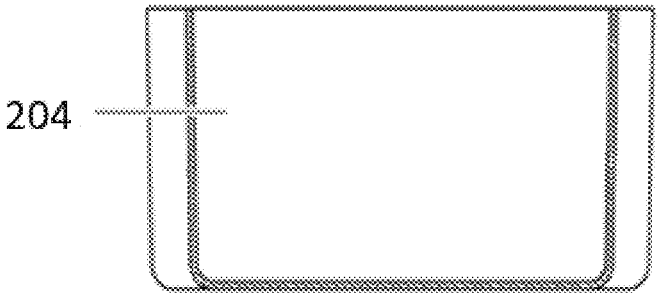
FIG. 2B illustrates a cross-sectional front view of the cap of the hair cleaning brush, in accordance with an exemplary embodiment of the present invention taken generally at plane 2B-2B of FIG. 3.
Figure 3:
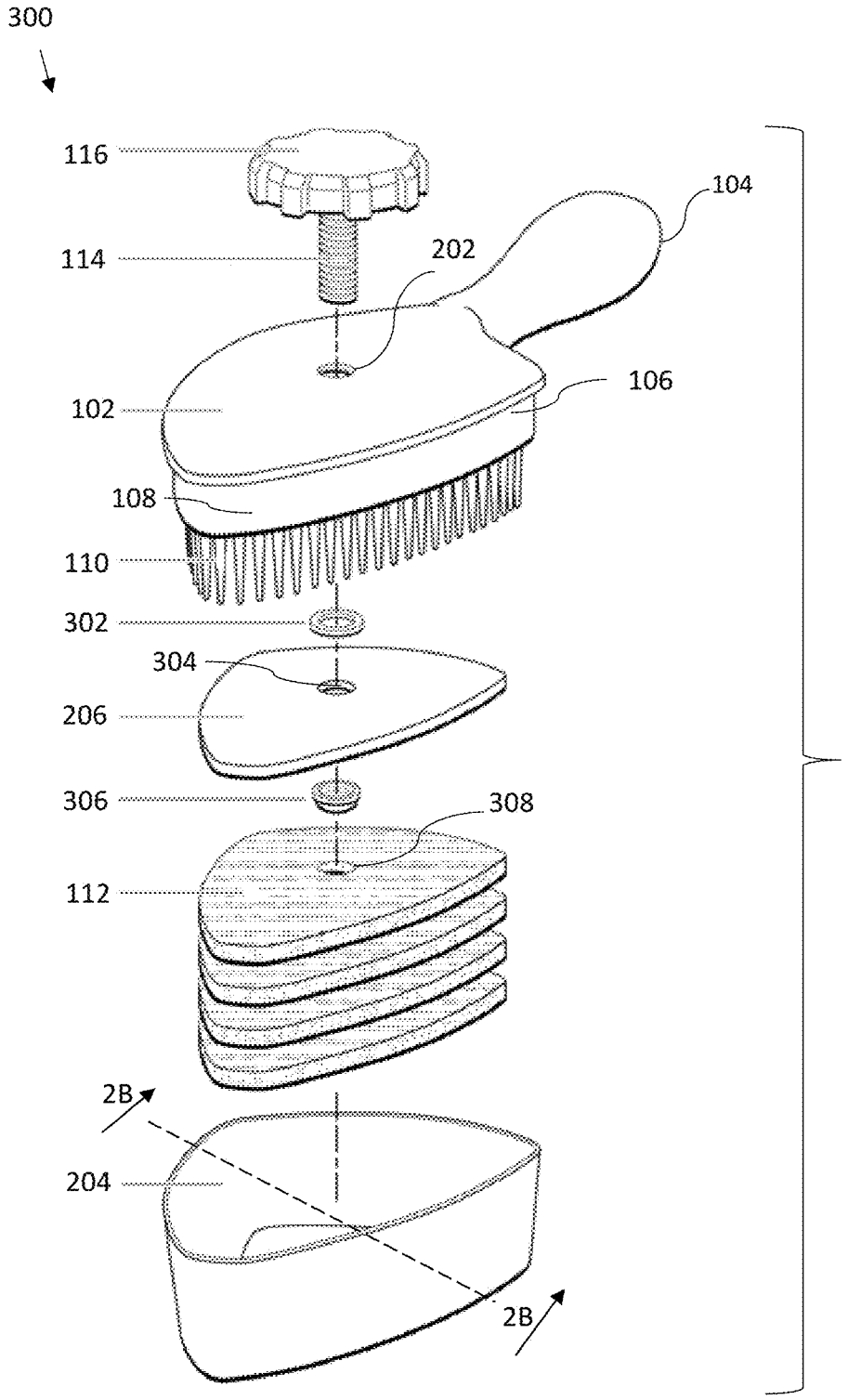
FIG. 3 is an exploded view of the hair cleaning brush, in accordance with a preferred embodiment of the present invention.

FIG. 2B illustrates a cross-sectional front view of the cap (204) of the hair cleaning brush, in accordance with an exemplary embodiment of the present invention taken generally at plane 2B-2B of FIG. 3. The cap (204) is enabled to cover the plurality of bristles and one or more sponge pads of the brush body.

FIG. 3 is an exploded view (300) of the hair cleaning brush, in accordance with a preferred embodiment of the present invention. The hair cleaning brush comprises the brush body (102) and the handle (104). The brush body (102) is having the top side (106) and the bottom wall (108), wherein the bottom wall (108) is extending from a periphery of the top side (106). The plurality of bristles (110) are extending from a periphery of the bottom wall (108) of the brush body (102) forming a space in between the brush body (102) to place one or more sponge pads (112). The plurality of bristles (110) is spaced apart from each other. The brush body (102) comprises the hole (202) in the middle of the top side (106) of the brush body (102). The threaded adjusting rod (114) is sized, shaped and designed to pass through the hole (202) of the brush body (102) to engage with one or more threads (304) of a pusher plate (206) to hold the pusher plate (206). A threaded pusher ring (302) is fastened to the pusher plate (206) that enables the threaded adjusting rod (114) to hold the pusher plate (206) inside the brush body (102). Further, a nylon acorn-style cap (306) is fastened between the pusher plate (206) and the one or more sponge pads (112) enabling the threaded adjusting rod (114) to hold the pusher plate (206) and the one or more sponge pads (112) inside the brush body (102). The one or more sponge pads (112) are placed on the top of the pusher plate (206).

Further, the one or more sponge pads (112) are having a hole (308) in the middle of the one or more sponge pads (112) enabling the threaded adjusting rod (114) to pass therethrough to hold the one or more sponge pads (112) on the pusher plate (206). The pusher plate (206) and the one or more sponge pads (112) are having the same length. The threaded adjusting rod (114) is configured to displace the pusher plate (206) and one or more sponge pads (112) from a first position to a second position inside the brush body (102), in response to rotation of the rotary knob (116) in at least one direction by the user. Further, the hair cleaning brush comprises a cap (204) enabled to cover the hair cleaning brush to keep the plurality of bristles (110) and one or more sponge pads (112) of the brush body (102) fresh, clean and dirt free when not in use.

Figure 4A:
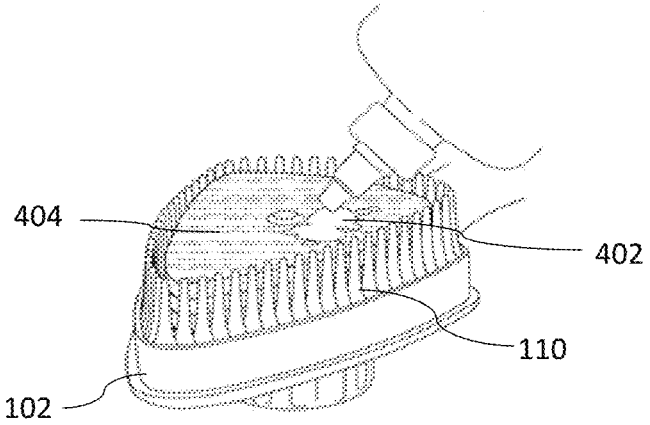
FIG. 4A is a perspective view of a brush body comprising a cleaning fluid, in accordance with an exemplary embodiment of the present invention.

FIG. 4A is a perspective view of a brush body (102) having a cleaning fluid, in accordance with an exemplary embodiment of the present invention. The user of the hair cleaning brush can pour or apply a cleaning fluid (402) on the sponge pad (404) as shown in the figure. The sponge pad (404) is enabled to soak the cleaning fluid (402). The cleaning fluid (402) is selected from a group consisting of coconut oil, jojoba oil, olive oil, tea tree oil, or any other like cleaning/conditioning/detangling fluid used on hair or animal fur.

Figure 4B:
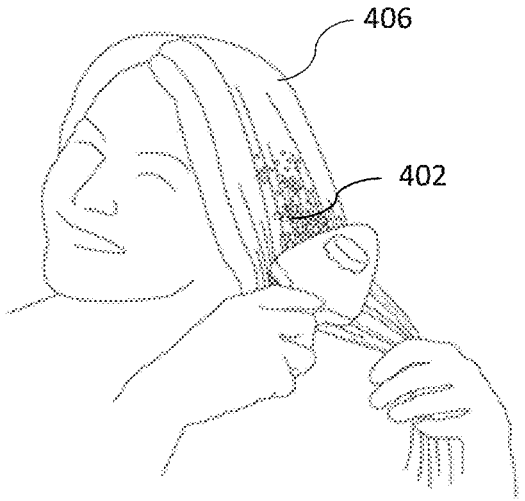
FIG. 4B is a perspective view of a user applying the cleaning fluid on her hair, in accordance with an exemplary embodiment of the present invention.

FIG. 4B is a perspective view of a user applying the cleaning fluid on her hair, in accordance with an exemplary embodiment of the present invention. With reference to FIGS. 4A and 4B, the sponge pad (404) is enabled to absorb the cleaning fluid (402) that is distributed to a user's hair (406) through the plurality of bristles (110) and the sponge pad (404) while combing. The cleaning fluid (402) is enabled to clean the user hair (406) by passing it on to the user's hair (406) from the sponge pad (404). The cleaning fluid (402) is not restricted to a single type of liquid. The choice of cleaning fluid (402) also depends on whether it has to be used on human hair or animal fur.

Figure 5A:
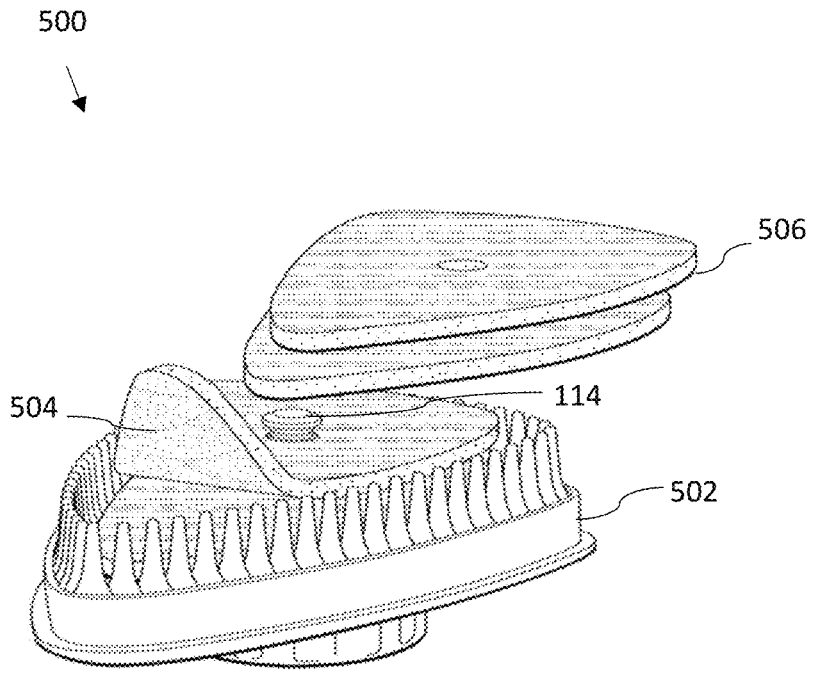
FIG. 5A is a perspective view of the pear-shaped brush body, in accordance with an exemplary embodiment of the present invention.

FIG. 5A is a perspective view (500) of the pear-shaped brush body, in accordance with an exemplary embodiment of the present invention. The brush body (502) comprises one or more replaceable sponge pads. The used sponge pad (504) can be replaced with a new sponge pad (506) by easily pulling out the used sponge pad (504) from the threaded adjusting rod (114).

Figure 5B:
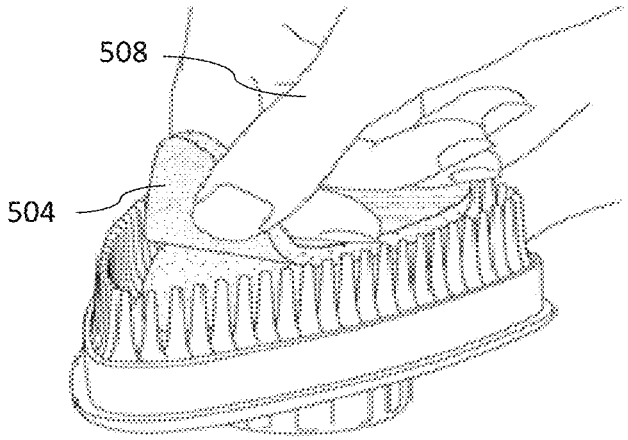
FIG. 5B is a perspective view of the user removing the sponge pad from the hair cleaning brush, in accordance with an exemplary embodiment of the present invention.

FIG. 5B is a perspective view of the user removing the sponge pad from the hair cleaning brush, in accordance with an exemplary embodiment of the present invention. The user of the hair cleaning brush is enabled to replace the used sponge pad (504) with the new sponge padby easily pulling out the used sponge pad (504) from the threaded adjusting rod using his fingers (508). The sponge pads are replaced to keep the sponge pad fresh and clean.

FIG. 6 is an exploded view (600) of the hair cleaning brush and one or more sponge pads, in accordance with an exemplary embodiment of the present invention. The brush body (602) of the hair cleaning brush is designed to hold-sponge pads of different sizes. The brush body (602) is enabled to accommodate a variety of sponge pads which can be any one of the following: single sponge (604), a set of four sponge pads (606), or four slit sponge pads (608). The sponge pads can be varied as desired by the user. The sponge pads can be adjusted inside the brush body (602) using the rotary knob (610).

In another exemplary embodiment, the present invention provides a method for cleaning hair. The method comprising pouring a cleaning fluid on a sponge pad of a hair cleaning brush, wherein the hair cleaning brush comprising a brush body and a handle, wherein the brush body having a plurality of bristles extending from a periphery the brush body, wherein the brush body having a threaded adjusting rod in the middle of the brush body, wherein the threaded adjusting tool is enabled to hold a pusher plate and the sponge pad inside the brush body, wherein the sponge pad is placed on the top of the pusher plate, placing the hair cleaning brush along the hair with the plurality of bristles and the sponge pad contacting the hair and moving the hair cleaning brush along the hair to apply the cleaning fluid present on the sponge pads on the hair by gripping the handle; wherein the plurality of bristles assists in applying the cleaning fluid on the hair.

Many modifications and other embodiments of the disclosure set forth herein will come to mind to one skilled in the art to which these embodiments pertain, having the benefit of the teachings presented in the foregoing descriptions and the associated drawings. Therefore, it is to be understood that the embodiments are not to be limited to the specific embodiments disclosed and that modifications and other embodiments are intended to be included within the scope of the appended claims. Although specific terms are employed herein, they are used in a generic and descriptive sense only and not for purposes of limitation.

Although the present invention has been described with reference to specific exemplary embodiments, it will be evident that the various modifications and changes can be made to these embodiments without departing from the broader scope of the invention. Accordingly, the specification and drawings are to be regarded in an illustrative sense rather than in a restrictive sense. It will also be apparent to the skilled artisan that the embodiments described above are specific examples of a single broader invention that may have greater scope than any of the singular descriptions taught. There may be many alterations made in the descriptions without departing from the scope of the present invention.

What I claim is:

1. A hair cleaning brush comprising:

a brush body and a handle;

a brush body having a top side and a bottom wall extending from a periphery of the top side;

a plurality of bristles extending from a periphery of the bottom wall of the brush body;

a hole in the middle of the brush body;

a threaded adjusting rod sized, shaped and designed to pass through the hole of the brush body to engage with one or more threads of a pusher plate to hold the pusher plate and one or more sponge pads inside the brush body, wherein the one or more sponge pads are placed on the top of the pusher plate; and a rotary knob, affixed at a top side of the threaded adjusting rod, enabled to provide a plurality of positions for the one or more sponge pads by displacing the pusher plate.

2. The hair cleaning brush of claim 1, wherein the one or more sponge pads are replaceable.

3. The hair cleaning brush of claim 1, wherein the one or more sponge pads are enabled to absorb a cleaning fluid that is distributed to a user's hair through the plurality of bristles and the one or more sponge pads while combing.

4. The hair cleaning brush of claim 3, wherein the cleaning fluid is selected from a group consisting of coconut oil, jojoba oil, olive oil, tea tree oil, or any other cleaning fluid.

5. The hair cleaning brush of claim 1, further comprises:

a cap enabled to cover the plurality of bristles and one or more sponge pads of the brush body.

6. The hair cleaning brush of claim 1, wherein the brush body and the handle are made of nylon material.

7. The hair cleaning brush of claim 1, wherein the pusher plate having one or more threads in the middle of the pusher plate.

8. The hair cleaning brush of claim 1, wherein the one or more sponge pads are having a hole in the middle of the one or more sponge pads.

9. The hair cleaning brush of claim 1, wherein the plurality of positions is a first position and a second position and wherein the threaded adjusting rod is configured to displace the pusher plate and one or more sponge pads from the first position to the second position inside the brush body, in response to rotation of the rotary knob in at least one direction by a user.

10. The hair cleaning brush of claim 9, wherein the first position is a proximate end of the plurality of bristles that is attached to the brush body, and the second position is a distal end of the plurality of bristles that is not attached to the brush body.

* * * * *